US005896862A

United States Patent [19]

Hwang

[11] Patent Number: 5,896,862

[45] Date of Patent: Apr. 27, 1999

[54] HAIR CLIP STRUCTURE HAVING A COMB CONCEALED THEREIN

[76] Inventor: Huoy-Jen Hwang, P.O. Box 82-144, Taipei, Taiwan

[21] Appl. No.: 09/139,575

[22] Filed: Aug. 25, 1998

[51] Int. Cl.[6] ..... A45D 24/38; A45D 24/00; A45D 8/00

[52] U.S. Cl. ..... 132/145; 132/144; 132/148; 132/276

[58] Field of Search ..... 132/145, 144, 132/143, 148, 273, 275, 276, 277, 278, 279

[56] References Cited

U.S. PATENT DOCUMENTS

| | | | |
|---|---|---|---|
| 242,086 | 11/1881 | Braun | 132/145 |
| 849,766 | 4/1907 | Baker | 132/145 |
| 1,386,296 | 8/1921 | Wessa | 132/144 |
| 5,694,956 | 12/1997 | Grinszpan | 132/275 |

*Primary Examiner*—John J. Wilson
*Assistant Examiner*—Trang Doan
*Attorney, Agent, or Firm*—A & J

[57] ABSTRACT

A hair clip structure having a comb concealed therein includes a plate body, an elastic clip, and a comb. The plate body has an inner acting face on which the elastic clip is secured using bolts. Left and right ends of the plate body are respectively provided with left and right tracks, that are respectively provided with openings on opposed faces and lower portions for receiving the comb that is pushed in between the left and right tracks from a lower end of the plate body. The left and right tracks on the plate body are provided with left and right limiting grooves each having a stop boss. An intermediate limiting groove having upper and lower stop projections is disposed between the left and right limiting grooves. The comb is also provided with a plurality of stop studs at a base end such that, when the comb is pushed upwardly or downwardly on the plate body and when the comb is disposed between the left and right tracks, the stop studs can perform stopping or checking functions along the left and right limiting grooves and the intermediate limiting groove. Hence, a structure in which the comb can be pushed downwardly for combing purposes or can be concealed in the inner acting face of the plate body is achieved.

1 Claim, 6 Drawing Sheets

HAIR CLIP STRUCTURE HAVING A COMB CONCEALED THEREIN

BACKGROUND OF THE INVENTION

1. Field of the Invention

The present invention relates to a hair clip structure, and more particularly to a hair clip structure having a comb concealed therein.

2. Description of the Prior Art

Hair clips and hair combs have their respective functions. Hair clips are used to fasten hair in position. Combs are used to groom the hair. For women, these two items are inseparable, and they often put both of them in their handbags. However, women may carry many items in their handbags, and it is desirable to have a structure that incorporates the functions of both a hair clip and a comb to space storage space and to facilitate carrying.

SUMMARY OF THE INVENTION

The present invention relates to a hair clip structure, and more particularly to a hair clip structure having a comb concealed therein.

A primary object of the present invention is to provide a hair clip structure having a comb concealed therein.

According to the present invention, the hair clip structure having a comb concealed therein comprises a plate body, an elastic clip, and a comb. The plate body is provided with left and right tracks for concealing the comb, and left and right limiting grooves and an intermediate limiting groove that cooperate with stop studs on the comb to allow the comb to move smoothly between the left and right tracks. The left and right limiting grooves are respectively provided with a lower stop boss at lower openings of the left and right tracks, whereas the intermediate limiting groove is provided with upper and lower stop projections, whereby the comb can be checked and secured when pushed upwardly and received in an acting face of the plate body, and will not slip when pushed downwardly for combing purposes.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
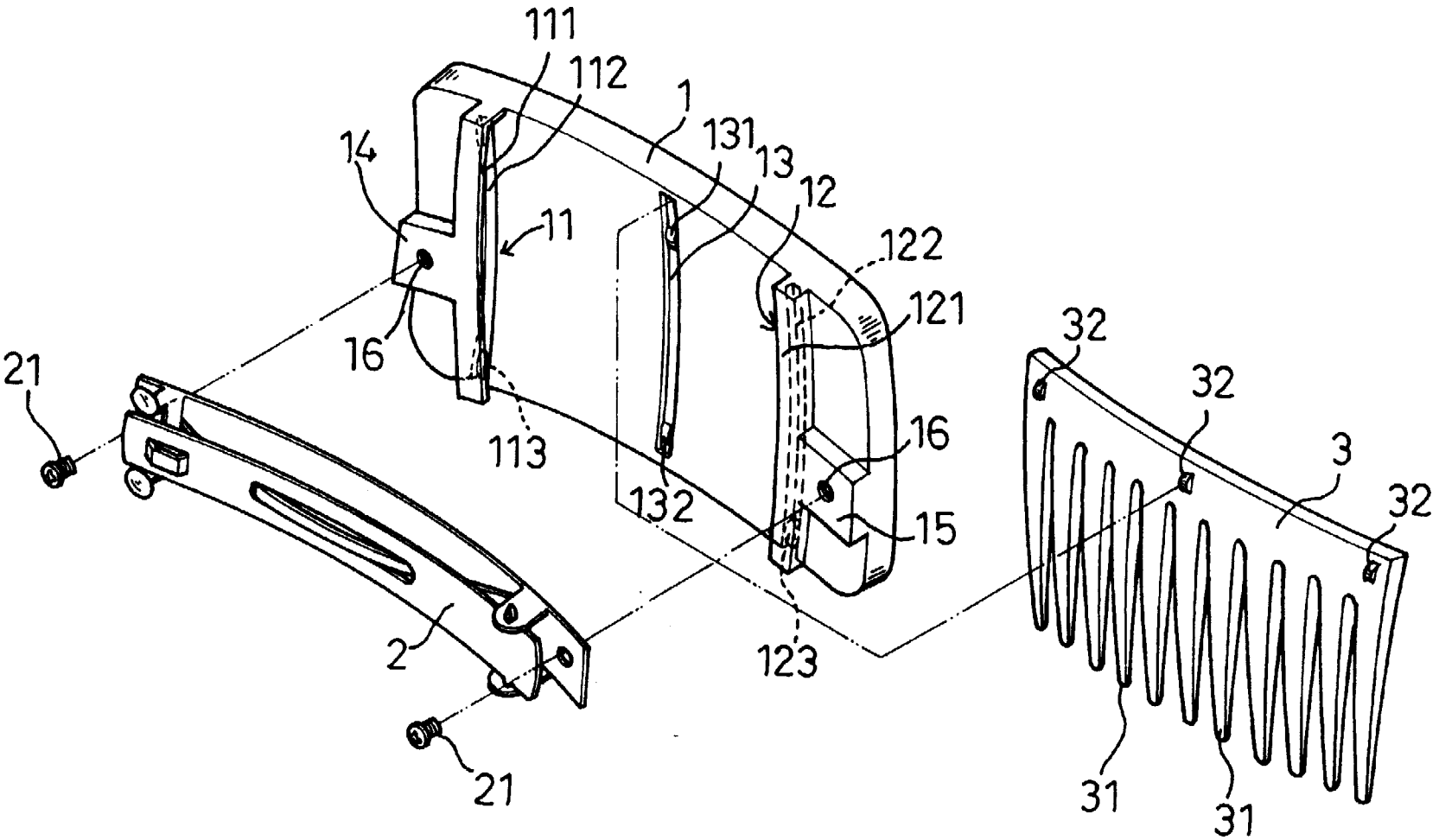
FIG. 1 is a perspective exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to FIG. 1, the present invention is shown to comprise a plate body 1 having an inner acting face, an elastic clip 2, and a comb 3. The plate body 1 is provided with left and right tracks 11, 12 at left and right ends thereof in appropriate positions. The left and right tracks 11, 12 respectively have left and right track walls 111, 112. Openings are formed on opposed sides of the left and right track walls 111, 112 and at the lower portions. The left and right tracks 11, 12 on the plate body 1 are further provided with left and right limiting grooves 112, 122 respectively. In relation to the openings of the left and right tracks 11, 12, the left and right limiting grooves 112, 122 are provided with lower stop bosses 113, 123, respectively. An intermediate limiting groove 13 is further provided on the plate body 1 between the opposed openings of the left and right tracks 11, 12. Upper and lower ends of the intermediate limiting groove 13 are respectively provided with upper and lower stop projections 131, 132. In addition, left and right securing seats 14, 15 are disposed near the left and right track walls 111, 121. The left and right securing seats 14, 15 are respectively provided with screw holes 16, whereby bolts 21 can be used to secure the elastic clip 2 on the plate body 1.

The comb 3 has a width sufficient to be accommodated in the plate body 1 between the left and right tracks 11, 12. It has an array of teeth 31. A base end of the comb 3 is further provided with stop studs 32 to correspond to the left and right limiting grooves 112, 122 and the intermediate limiting groove 13 of the plate body 1.

Figure 2:
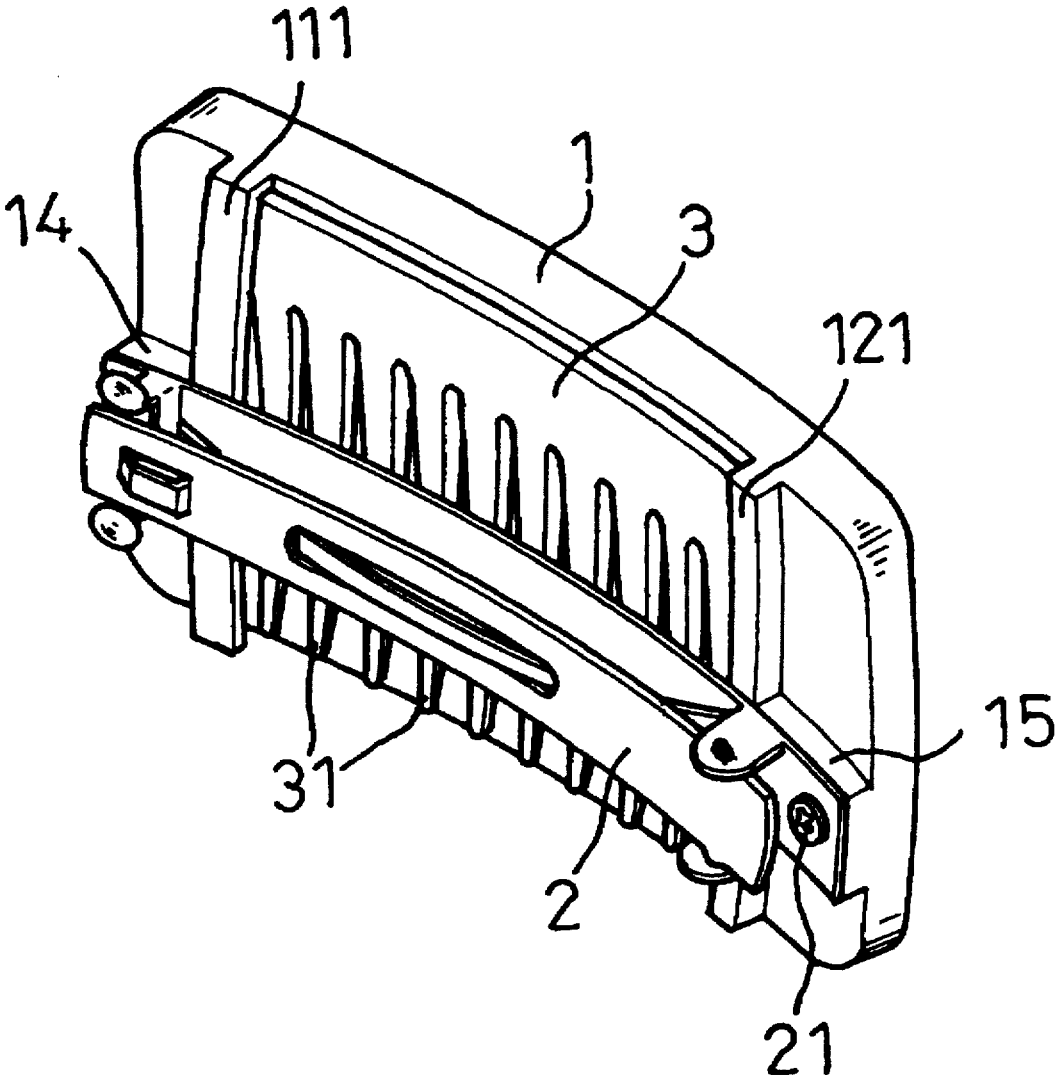
FIG. 2 is a perspective assembled view of the present invention.
Figure 4:
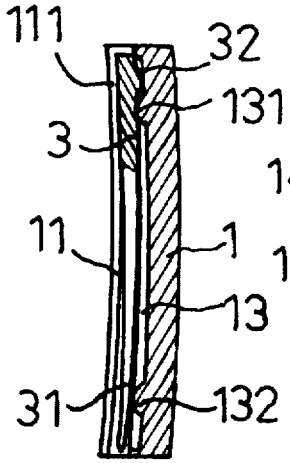
FIG. 4 is a sectional view taken along line A—A of FIG. 3.
Figure 3:
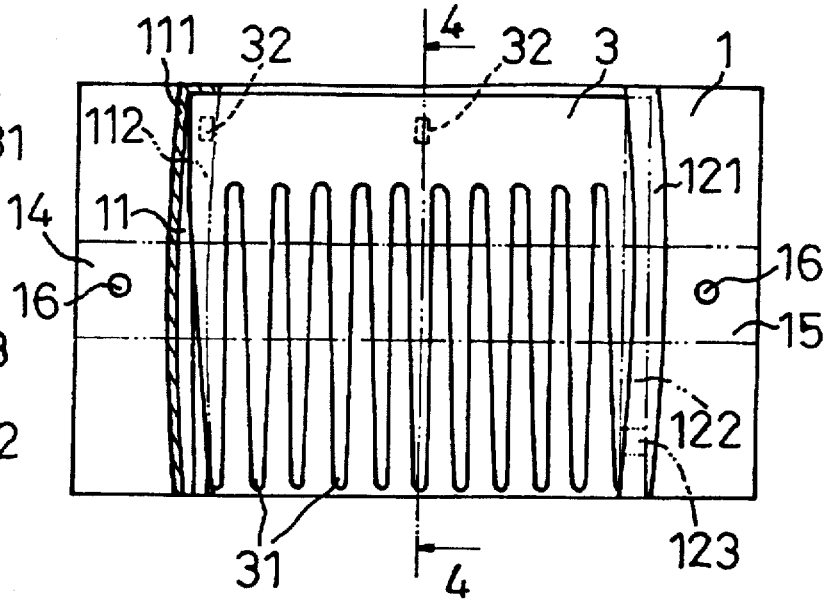
FIG. 3 is a sectional view illustrating a comb that is concealed on an acting face of a plate body.

During assembly, the comb 3 is guided in between the left and right tracks 11, 12 from the lower end of the plate body 1. By exerting a force, the stop studs 32 of the comb 3 are passed over the lower stop bosses 113, 123 and the lower stop projection 132 into the left and right limiting grooves 112, 122 and the intermediate limiting groove 13. When the stop studs 32 of the comb 3 are checked by the upper stop projection 131, the comb 3 will be completely concealed in the inner acting face of the plate body 1 between the left and right tracks 11, 12 (as shown in FIGS. 3 and 4). The elastic clip 2 is then secured to the left and right securing seats 14, 15 by means of passing bolts 21 into the screw holes 16, achieving the state as shown in FIG. 2.

Figure 6:
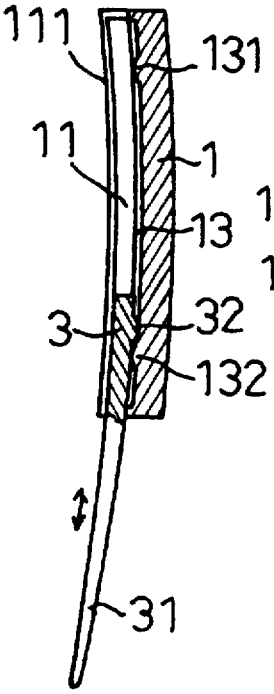
FIG. 6 is a sectional view of FIG. 5.
Figure 5:
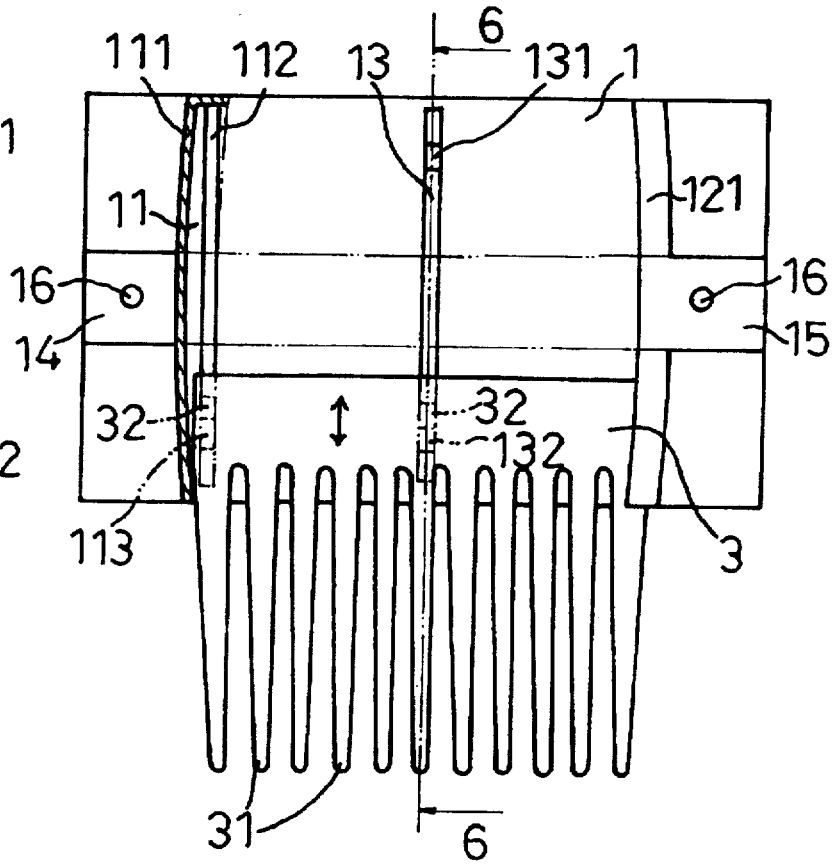
FIG. 5 is a sectional view illustrating the comb that has been pushed downwardly of the plate body for combing purposes.
Figure 7:
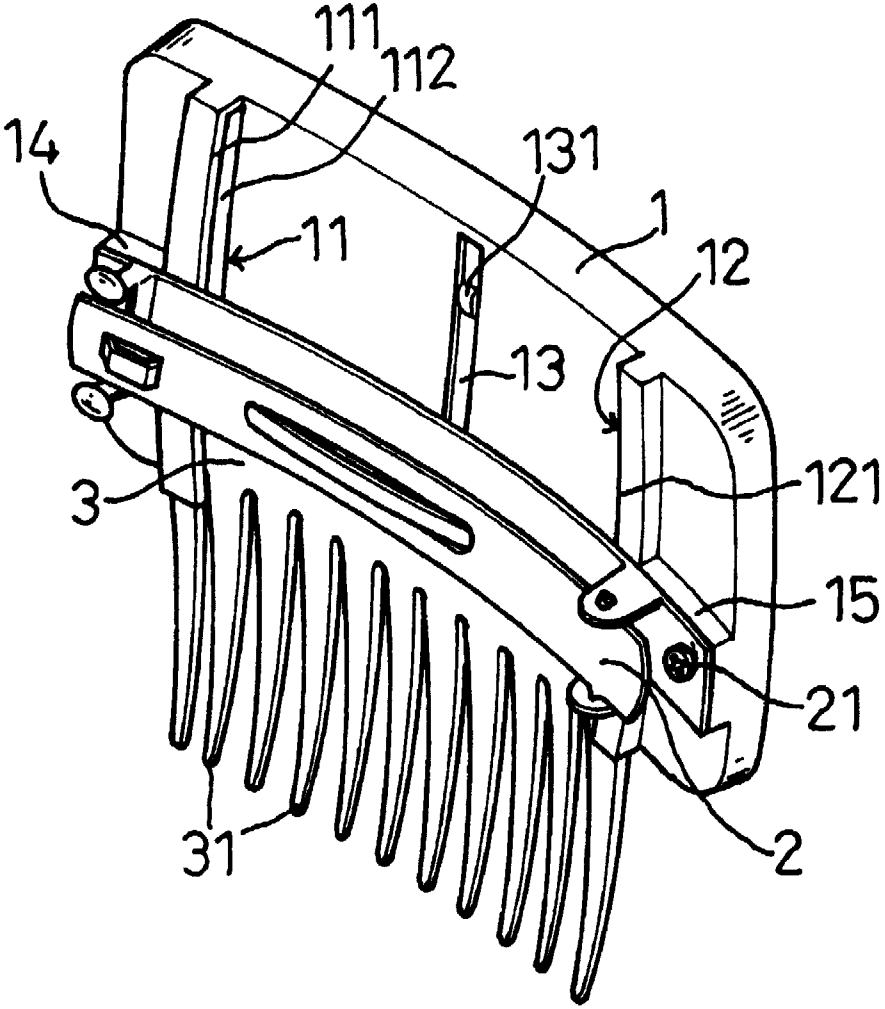
FIG. 7 is a perspective view of FIG. 5.
Figure 8:
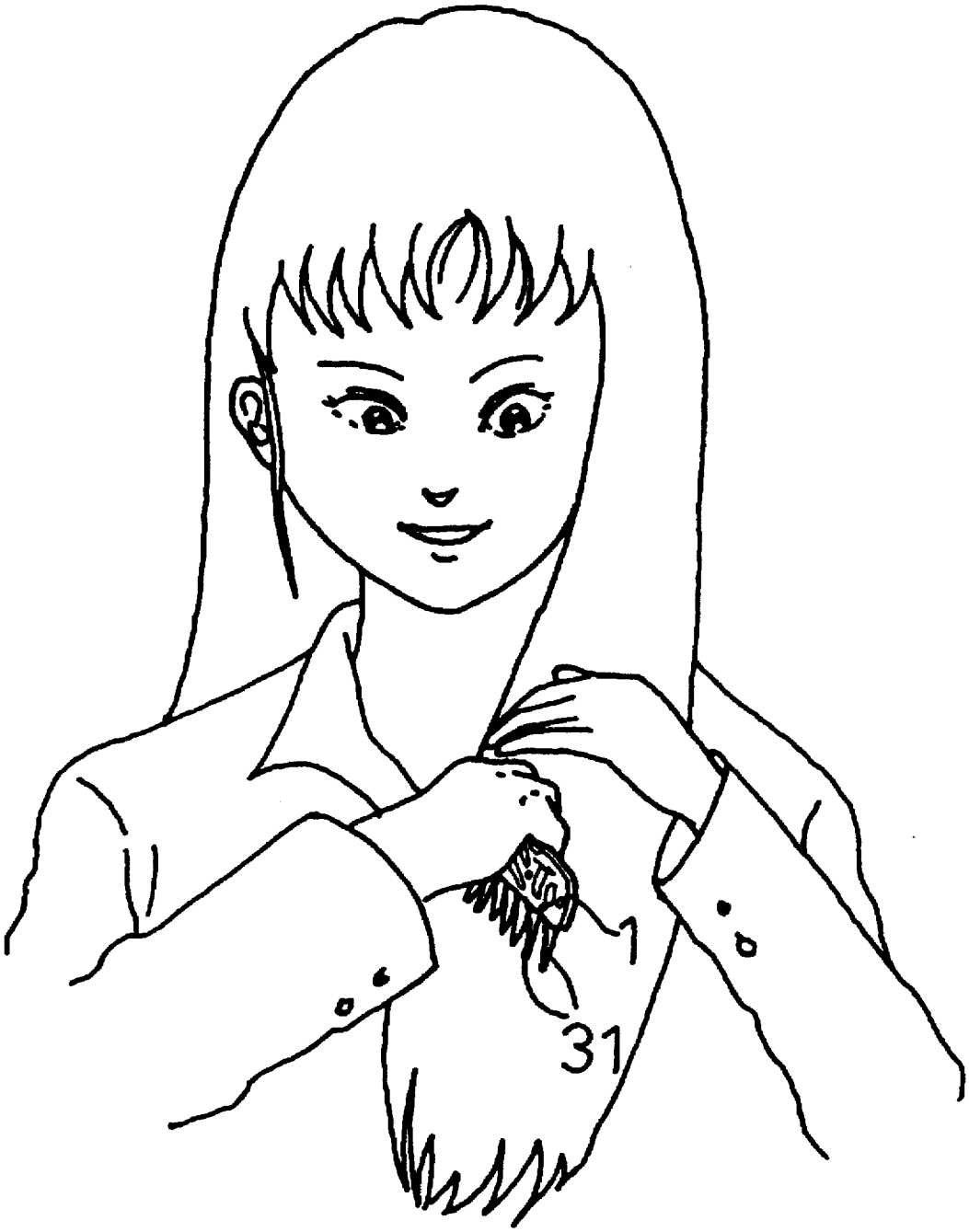
FIG. 8 illustrates an example of use of the present invention.

In use, referring to FIGS. 5, 6, and 7, the comb 3 can be pushed downwardly until the stop studs 32 on the base end of the comb 3 are checked by the lower stop bosses 113, 123 and the lower stop projection 132, so that the teeth 31 are exposed from the lower end of the plate body 1. The exposed teeth 31 can then be used for combing hair (as shown in FIG.

Figure 9:
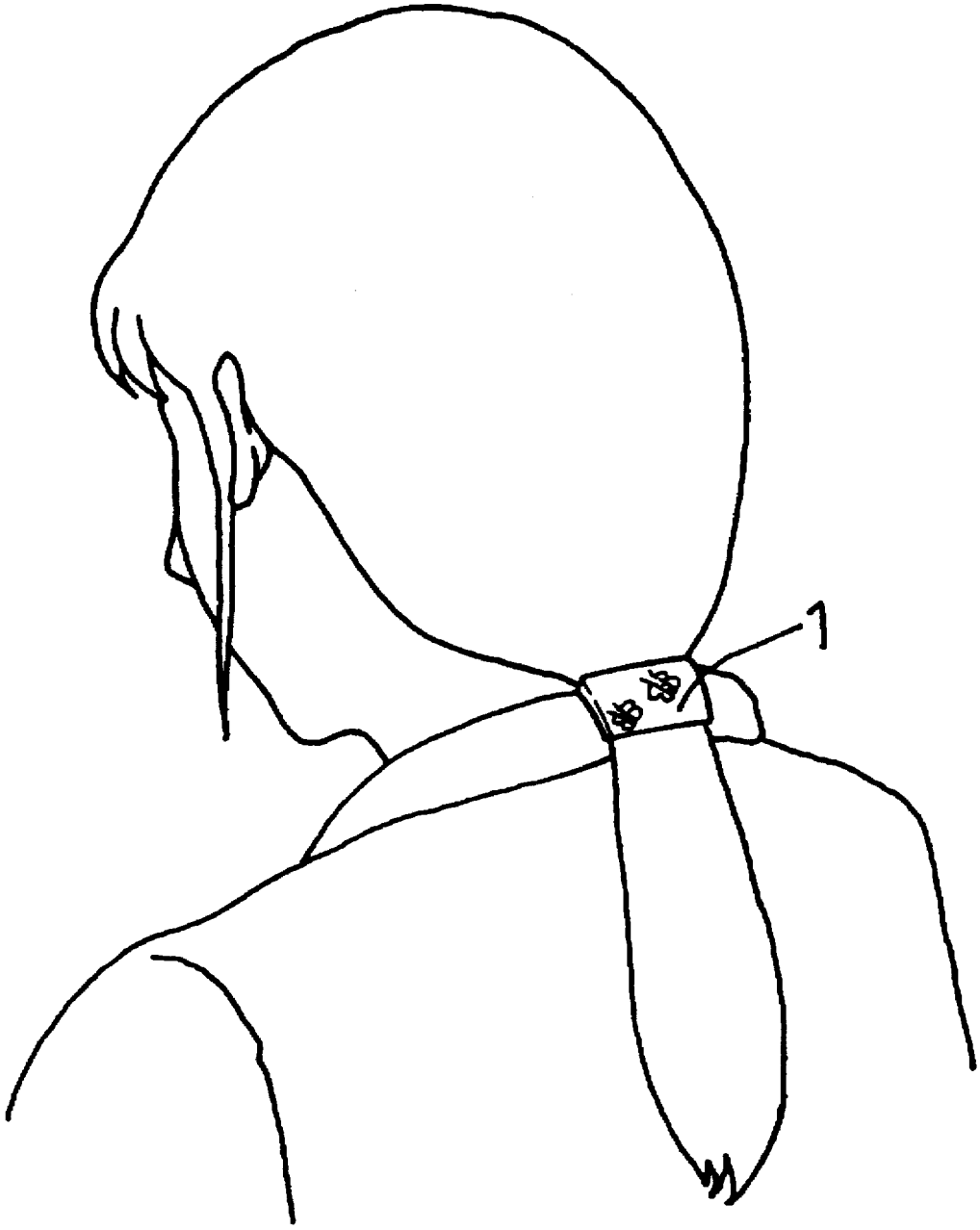
FIG. 9 shows another example of use of the present invention.

8). After combing, the comb 3 can be pushed upwardly until the stop studs 32 are checked by the upper stop projection 131. The present invention can then be used as a hair clip by utilizing the elastic clip 2 (as shown in FIG. 9).

In summary, the effects of the present invention are achieved by utilizing a plate body provided with left and right tracks for concealing a comb. The present invention can be used as a hair clip when going out. And when combing is desired, the comb held between the left and right tracks on the plate body can be pushed downwardly to expose the comb teeth for combing purposes. After combing, the comb can then be pushed up to be concealed between the left and right tracks of the plate body. It can therefore be appreciated that the present invention combines the function of a hair clip and a comb to save storage space. Furthermore, the left and right limiting grooves and the intermediate limiting groove on the plate body allow the comb to move upwardly or downwardly in a smooth manner. The upper and lower stop bosses, as well as the upper and lower projections, on the other hand, secure the comb when concealed on the inner acting face of the plate body and during combing.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A hair clip structure having a comb concealed therein, comprising a plate body, a an elastic clip, and a comb, said plate body including an acting face having left and right securing seats provided on left and right ends thereof, said left and right securing seats respectively having screw holes through which bolts can pass to secure said elastic clip to said left and right securing seats;

said comb having an array of teeth, wherein left and right tracks are respectively provided on a respective side of said left and right securing seats, opposed faces and lower portions of track walls of said left and right tracks being provided with openings, whereby said comb can be pushed from a lower end of said plate body in between a receiving space defined between said left and right track, said left and right tracks being further provided with left and right limiting grooves on said plate body, said left and right limiting grooves being respectively formed with a lower stop boss at respective openings at lower portions of said left and right tracks, an intermediate limiting groove being provided between said left and right limiting grooves and having upper and lower stop projections, said comb being provided with stop studs on a base end to correspond to said left and right limiting grooves and said intermediate limiting groove, whereby after said comb is pushed in between said left and right tracks from the lower end of said plate body, said stop studs on said comb can be used to allow said comb to slidably displace along said left and right limiting grooves and said intermediate groove;

when said comb is pushed upwardly, said comb can be checked by said upper stop projection; and when said comb is pushed downwardly, said comb may be checked by said lower stop bosses and said lower stop projection, thus achieving a hair clip structure in which said comb can be concealed in said acting face of said plate body and can be pushed downwardly for combing purposes.

* * * * *